US007938054B2

(12) United States Patent
Trigo et al.

(10) Patent No.: US 7,938,054 B2
(45) Date of Patent: May 10, 2011

(54) GAS SPRING FOR A REVOLVER CANNON OR BREECH CANNON

(75) Inventors: Marcos Trigo, Steinhausen (CH); Michael Gerber, Zurich (CH)

(73) Assignee: Rheinmetall Air Defence AG, Zurich (CH)

( * ) Notice: Subject to any disclaimer, the term of this patent is extended or adjusted under 35 U.S.C. 154(b) by 0 days.

(21) Appl. No.: 11/600,564

(22) Filed: Nov. 16, 2006

(65) Prior Publication Data

US 2007/0169617 A1 Jul. 26, 2007

(30) Foreign Application Priority Data

Jan. 24, 2006 (DE) ..... 10 2006 003 510

(51) Int. Cl.
*F41A 19/02* (2006.01)

(52) U.S. Cl. ..... 89/129.01; 89/191.01; 89/192; 89/193

(58) Field of Classification Search ..... 89/129.01, 89/191.01, 192–193
See application file for complete search history.

(56) References Cited

U.S. PATENT DOCUMENTS

| | | | | | |
|---|---|---|---|---|---|
| 2,525,021 | A * | 10/1950 | Douglas | 60/371 |
| 2,973,694 | A | 3/1961 | Herlach et al. | |
| 3,636,813 | A * | 1/1972 | Wiemers | 89/43.01 |
| 3,745,880 | A * | 7/1973 | Metz et al. | 89/43.01 |
| 3,996,916 | A * | 12/1976 | Koehn et al. | 124/72 |
| 4,656,921 | A * | 4/1987 | Zierler | 89/43.01 |
| H1010 | H | 1/1992 | Kasten et al. | |
| 5,193,517 | A * | 3/1993 | Taylor et al. | 124/67 |
| 5,524,374 | A * | 6/1996 | Gernstein | 42/1.06 |
| 5,570,676 | A * | 11/1996 | Gore | 124/56 |
| 5,617,664 | A * | 4/1997 | Troncoso | 42/1.06 |
| 6,481,669 | B1 * | 11/2002 | Griffin | 244/137.4 |
| 6,668,478 | B2 * | 12/2003 | Bergstrom | 42/1.06 |
| 6,782,791 | B2 * | 8/2004 | Moore | 89/1.4 |
| 6,802,406 | B2 * | 10/2004 | Martin | 188/274 |
| 6,901,689 | B1 * | 6/2005 | Bergstrom | 42/1.06 |
| 2002/0178901 | A1 * | 12/2002 | Bergstrom | 89/198 |
| 2003/0172800 | A1 * | 9/2003 | Trigo et al. | 89/178 |
| 2007/0169617 | A1 * | 7/2007 | Trigo et al. | 89/191.01 |

FOREIGN PATENT DOCUMENTS

| | | | |
|---|---|---|---|
| GB | 579150 | | 7/1946 |
| GB | 2168453 | A * | 6/1986 |
| WO | WO 02/084200 | | 10/2002 |

* cited by examiner

*Primary Examiner* — Michael Carone
*Assistant Examiner* — Michael D David
(74) *Attorney, Agent, or Firm* — Lucas & Mercanti, LLP; Klaus P. Stoffel

(57) ABSTRACT

The characteristic of one or more of the gas springs themselves used in a revolver cannon or breech cannon is adjusted while the system is in operation. This is done by a separate, self-contained system, which can adjust the gas spring from hard to soft, for example, and back to harder/hard and can thus adjust the characteristic of the gas spring without the loss of gas. In the simplest embodiment, this system has two additional elements, preferably a reserve tank and a connecting line that connects the reserve tank to the gas spring via a valve.

6 Claims, 1 Drawing Sheet

GAS SPRING FOR A REVOLVER CANNON OR BREECH CANNON

BACKGROUND OF THE INVENTION

The invention pertains to a variable gas spring for a revolver or breech cannon.

In cannons with a self-powered drive/gas drive, the breech (in the case of a breech cannon) or the slide (in the case of a revolver cannon) is driven by the gas which forms during firing. The breech or slide is returned to the starting position by springs.

The use of gas springs instead of mechanical springs is known from EP 1 340 955 B1, which describes a weapon of the general type in question. In principle, the gas springs for high-power cannons have a defined spring characteristic, which is optimized for the each intended application.

Changing the setting, especially changing the setting rapidly to deal with changes in the operating conditions associated with, for example, the effects of temperature, cannot be accomplished without complicated gas systems with pressure control. When the pressure is switched from a high level to a low level, however, there is always a loss of gas, which must be compensated from appropriate reserve tanks.

SUMMARY OF THE INVENTION

Against this background, the task of the invention is to integrate into the dynamics of the cannon a device by means of which the characteristic of the springs involved therein can be varied without leading to the disadvantages cited above.

The invention is based on the idea of being able to adjust the characteristic of either one or several of the gas springs themselves according to the state of the art during the operation of the cannon. This is done by means of a separate, self-contained system, which can adjust the gas springs from hard to soft, for example, and back again to hard/harder and thus to adjust the characteristic of the gas spring without the loss of gas. In the simplest embodiment, this system consists preferably of two additional elements, namely, a reserve tank and a connecting line that connects the reserve tank to the gas spring via a valve. Various other designs, however, are also possible.

The system can be switched preferably between two different states. Thus, for example, it would be possible to adjust the springs to a softer setting during an ongoing process, e.g., during firing.

In addition, this system can support charging, where the reserve volume is connected to the system during the charging process. This has the effect that the energy required for charging is reduced, and the stress on the charging mechanism can also be decreased. Simultaneously, any pressure loss of the gas spring which may occur can be compensated.

The additional system can be used for one or more gas springs. A single gas tank or several of them (reserve tank 1) with the same or different pressures can be used. The system can be expanded to the extent desired.

In conventional gas systems with pressure control, the gas is released and then resupplied. The disadvantage therefore consists in the loss of the gas. In contrast, the type of control intended here takes place in the system itself without any loss of gas.

The advantages of the solution are to be found in the design of a variable spring characteristic, in greater reliability, and in the associated longer intervals between maintenance work as well as in the reduction of leakage incidents.

The system can be applied in conjunction with revolver cannons or breech cannons.

Other features and advantages of the present invention will become apparent from the following description of the invention that refers to the accompanying drawings.

BRIEF DESCRIPTION OF THE DRAWINGS

The invention is explained in greater detail below on the basis of an exemplary embodiment and its drawing.

DESCRIPTION OF THE INVENTION

Figure 2:
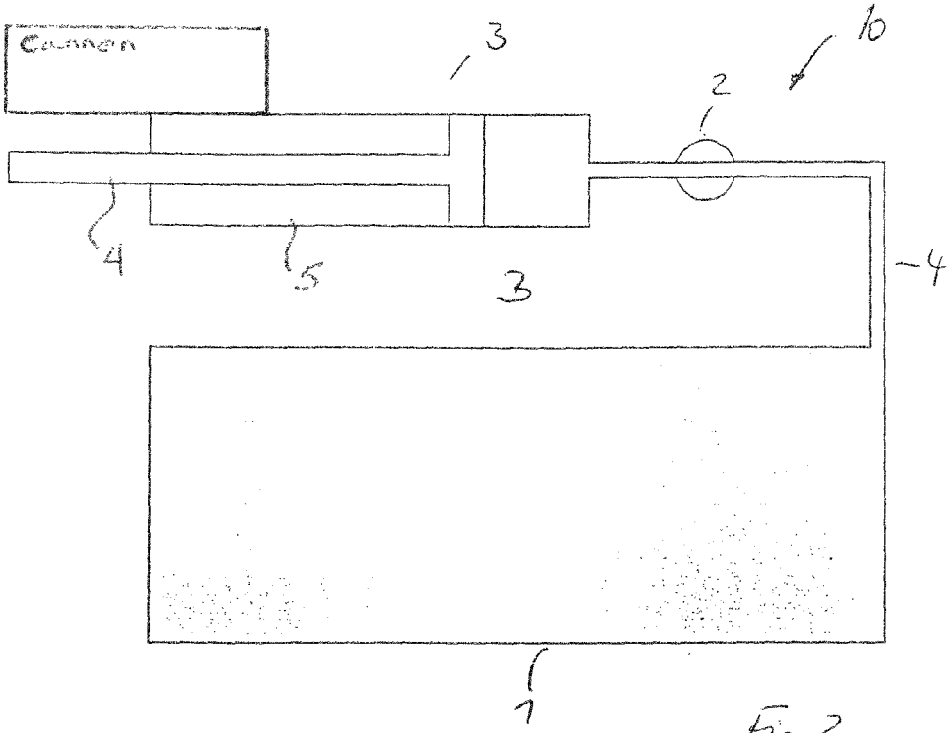
FIG. 2 shows a separate gas system in a second operating mode.
Figure 1:
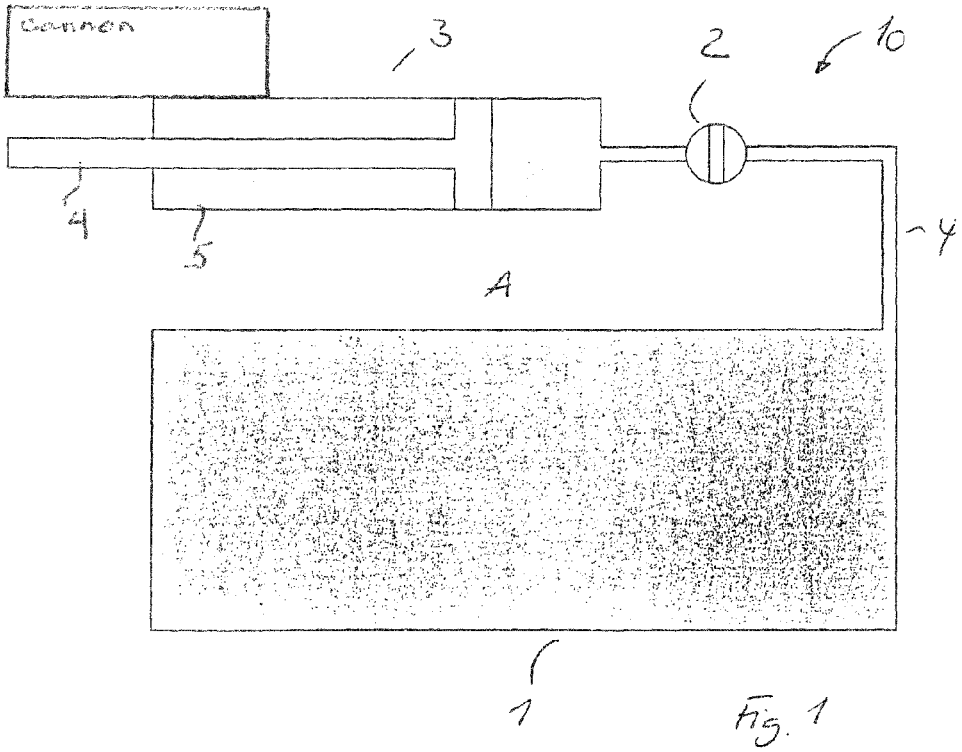
FIG. 1 shows a separate gas system in a first operating mode.

FIG. 1 and FIG. 2 show the additional gas system 10 for a gas spring 3 on the cannon side with at least one reserve tank 1, with a valve 2, and with a connecting line 4 in a first operating mode "A" or in a second operating mode "B". The gas spring has a piston 4 and cylinder 5 arrangement.

By itself, the cannon's own gas spring 3 is designed through its geometry and compression characteristics in such a way that operating mode "A" of the cannon is given optimal support. In this operating mode, the valve 2 is closed. By opening the valve 2 (FIG. 2), the volume of the gas spring 3 is increased. When the gas spring 3 is compressed, a different (softer) spring characteristic is obtained as a result of the different compression ratio, and this characteristic is more suitable for operating mode "B" of the cannon.

Through appropriate design of the additional gas system 10, the spring characteristic can be taken into account and the characteristic which is better for a certain firing scenario can be implemented. Thus, for example, operating mode "A" can be set for firing at a low rate of fire, whereas operating mode "B" can be set for firing at a higher rate of fire. This design can also be used to control the rate of fire automatically during firing. That is, firing could begin with the reserve volume connected to the circuit. If the rate of fire becomes too high during this firing phase, the valve 2 can be closed. As a result, the spring characteristic is increased and the rate of fire is reduced.

It is also possible to use several reserve tanks 1 with the same or different pressures.

Other features and advantages of the present invention will become apparent from the following description of the invention that refers to the accompanying drawings.

The invention claimed is:

1. A gas spring for a revolver cannon or a breech cannon, comprising:

a cannon;

a piston/cylinder arrangement; and an additional gas system integrated with the piston/cylinder arrangement so as to be useable to adjust the spring characteristic of the gas spring during operation of the cannon, the additional gas system being operative to automatically regulate a rate of fire of the cannon, whereby the spring characteristic of the gas spring is adjusted from hard to soft and back to hard so that the spring characteristic of the gas spring is adjusted without gas losses based on the rate of fire of the cannon.

2. The gas spring according to claim 1, wherein the additional gas system has at least one reserve tank which is connected to the gas spring by a valve and a connecting line.

3. The gas spring according to claim 2, wherein the system supports charging, and the reserve volume of the reserve tank being connected to the system for charging.

4. The gas spring according to claim 2, having a single reserve tank.

5. The gas spring according to claim 1, wherein the system is switchable between two operating modes.

6. The gas system according to claim 5, wherein the system supports two different operating modes during firing, where the first operating mode is settable for a lower rate of fire, and the second operating mode is settable for a higher rate of fire.

* * * * *